US006517379B2

(12) United States Patent
Leve

(10) Patent No.: US 6,517,379 B2
(45) Date of Patent: Feb. 11, 2003

(54) PLUG CONNECTOR

(75) Inventor: Ludger Leve, Rahden (DE)

(73) Assignee: Hartung Automotive GmbH & Co. KG (DE)

( * ) Notice: Subject to any disclaimer, the term of this patent is extended or adjusted under 35 U.S.C. 154(b) by 0 days.

(21) Appl. No.: 10/068,511

(22) Filed: Feb. 6, 2002

(65) Prior Publication Data

US 2002/0119699 A1 Aug. 29, 2002

(30) Foreign Application Priority Data

Feb. 28, 2001 (DE) ..... 101 09 719

(51) Int. Cl.[7] ..... H01R 9/05
(52) U.S. Cl. ..... 439/578; 439/584; 439/852
(58) Field of Search ..... 439/578, 852, 439/851, 579, 580, 581, 582, 583, 584

(56) References Cited

U.S. PATENT DOCUMENTS

| | | | | | |
|---|---|---|---|---|---|
| 3,708,781 | A | * | 1/1973 | Tompeter | 339/177 |
| 3,761,870 | A | * | 9/1973 | Drezin et al. | 339/177 |
| 3,846,738 | A | * | 11/1974 | Nepovin | 339/177 |
| 4,037,909 | A | * | 7/1977 | Tronpeter et al. | 339/177 |
| 4,178,054 | A | | 12/1979 | Laudig | |
| 4,995,836 | A | * | 2/1991 | Toramoto | 439/675 |
| 5,195,910 | A | * | 3/1993 | Enomoto et al. | 439/578 |
| 5,362,251 | A | * | 11/1994 | Bielak | 439/394 |
| 5,456,611 | A | * | 10/1995 | Henry et al. | 439/180 |
| 5,820,408 | A | * | 10/1998 | Wang | 439/578 |
| 6,027,373 | A | * | 2/2000 | Gray et al. | 439/578 |
| 6,071,127 | A | | 6/2000 | Acke et al. | 439/63 |
| 6,123,550 | A | | 9/2000 | Burkert et al. | 439/63 |

FOREIGN PATENT DOCUMENTS

| | | |
|---|---|---|
| CA | 1 416 133 | 4/1974 |
| DE | 3333897 | 4/1985 |
| WO | WO 01/13470 A1 | 2/2001 |

* cited by examiner

*Primary Examiner*—Tho D. Ta
*Assistant Examiner*—Truc Nguyen
(74) *Attorney, Agent, or Firm*—Hayes Soloway P.C.

(57) ABSTRACT

For a plug connector having a plug-in side and a conductor-connecting side for a coaxial cable, it is proposed that an insulating body with an electrical contact element is disposed in a sleeve-shaped plug-in part, the said insulating body having tongues which are spread apart and are separated by slots and which extend from an annular groove to the end of the insulating body, gradations which are forced into the insulation of the electrical middle conductor being provided on the inside of the tongues, and the electrical contact element being held in a centred manner in a receiving bore in the insulating body.

7 Claims, 3 Drawing Sheets

PLUG CONNECTOR

The invention relates to a plug connector for a coaxial cable, the said plug connector having a plug-in side and a conductor-connecting side and consisting of a sleeve-shaped, metal plug-in part into which an insulating body is pushed, in the process of which a contact element is introduced into the said insulating body.

The purpose of the invention is to achieve a plug connection between a plug connector for coaxial cables and a corresponding counter-plug or direct to a suitably contoured printed circuit board rim on a printed circuit board, wherein, however, high electrical reliability of plugging-in is to be guaranteed.

From EP 0 848 459 A2, a line plug connector for transmitting electrical energy between a coaxial cable and a printed circuit board is known, in which a printed circuit board is provided, in the region of its rim, with a number of elongated slots by means of which tongues are constructed whose flanks are subsequently metallised, and wherein a line plug connector of suitable design brings about an electrical contact between the metallised flanks and the electrical components of the plug part on the cable.

The problem with plug connectors of this type lies in achieving simple plug assembly with reliable screening and good electrical coupling between a plug-in contact and the signal-conveying electrical conductor of the coaxial cable, in order to guarantee interference-free signal transmission.

The underlying object of the invention is therefore to construct a plug connector of the initially mentioned type in such a way that easy and thereby cost-effective fitting with optimum screening and signal-conveyance, and also reliable electrical plugging-in of coaxial cables, are made possible by the use of a few simple components.

This object is achieved through the fact that the insulating body is provided, in a partial region, with tongues which are formed by longitudinal slots and which point outwards, that a number of central bores which are arranged in a row and differ in diameter are provided in the insulating body, that the ends of the tongues are provided, on their side which points towards the interior of the insulating body, with conical or widening gradations, that the middle conductor of the coaxial cable is introduced into a receiving bore in the contact element, and that the insulating body is pushed into the sleeve-shaped plug-in part, in the process of which the outwardly pointing tongues are pressed together and the gradations exert a pressure on the insulation of the middle conductor.

Provision is preferably made for the plug connector to be provided with an insulating body which is introduced into a sleeve-shaped metal plug-in part, is capable of centrally receiving an electrical contact element and connects a central electrical middle conductor of a coaxial cable to the said contact element.

Provision is also advantageously made for first of all providing a tension-relieving system for the central electrical middle conductor, and also for achieving further relief of tension between the sheath of the coaxial cable and the plug-in part, by means of crimping onto the sleeve-shaped plug-in part.

In its interior, the insulating body, which is constructed as an elongated round body, has a number of graduated diameters, while outwardly pointing tongues formed by longitudinal slots extend from a head part, which is segregated by a circumferential annular groove, as far as the end of the said insulating body.

The differently graduated bores in the interior of the insulating body are preferably coordinated with the outer diameters, which receive them, of the electrical contact element and of the coaxial cable.

Under these circumstances, gradations, which are forced into the insulation when the tongues are pressed together, are preferably provided in the insulating body in the region of the insulation of the electrical middle conductor.

For the secure retention and centering of the electrical contact element, the latter is advantageously provided with two thickened portions which are disposed in a spaced-apart manner and which are forced against the wall of the inner bore of the insulating body.

A conical widened portion of the inner diameter is additionally provided, which is, however, narrowed in such a way, when the tongues are pressed together, that the inner wall of the insulating body rests directly on the outer wall of the electrical contact element in this region and thus also exerts a pressure on the electrical middle conductor.

According to the preferred form of embodiment, provision is made for making reliable electrical contact with the screen by means of a lamellar spring. To that end, an annular lamellar-spring arrangement with lamellae which are disposed so as to be inclined by about 45° in relation to the perpendicular is pressed tightly into the front plug-in region of the plug-in part.

In this way, the plug connector can be plugged onto any matching counter-plug and also directly onto a printed circuit board which is suitably provided for that purpose.

The advantages obtained with the aid of the invention consist, in particular, in the fact that, as a result of this design, very simple handling is achieved during fitting, in the process of which the contact element is first of all pushed onto the middle conductor, which has been stripped of insulation, of a coaxial cable, the two parts are introduced into the insulating body, and these are inserted in turn, almost without any force, in the sleeve-shaped plug-in part and are finally connected to one another with the aid of a crimping operation in the region of the screen of the coaxial cable.

Advantageous refinements of the invention are indicated in claims 2 to 7.

An exemplified embodiment is represented in the drawings and will be explained in greater detail below. In the said drawings.

Figure 3B:
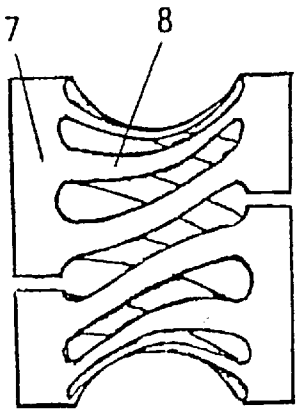
Figure 3A:
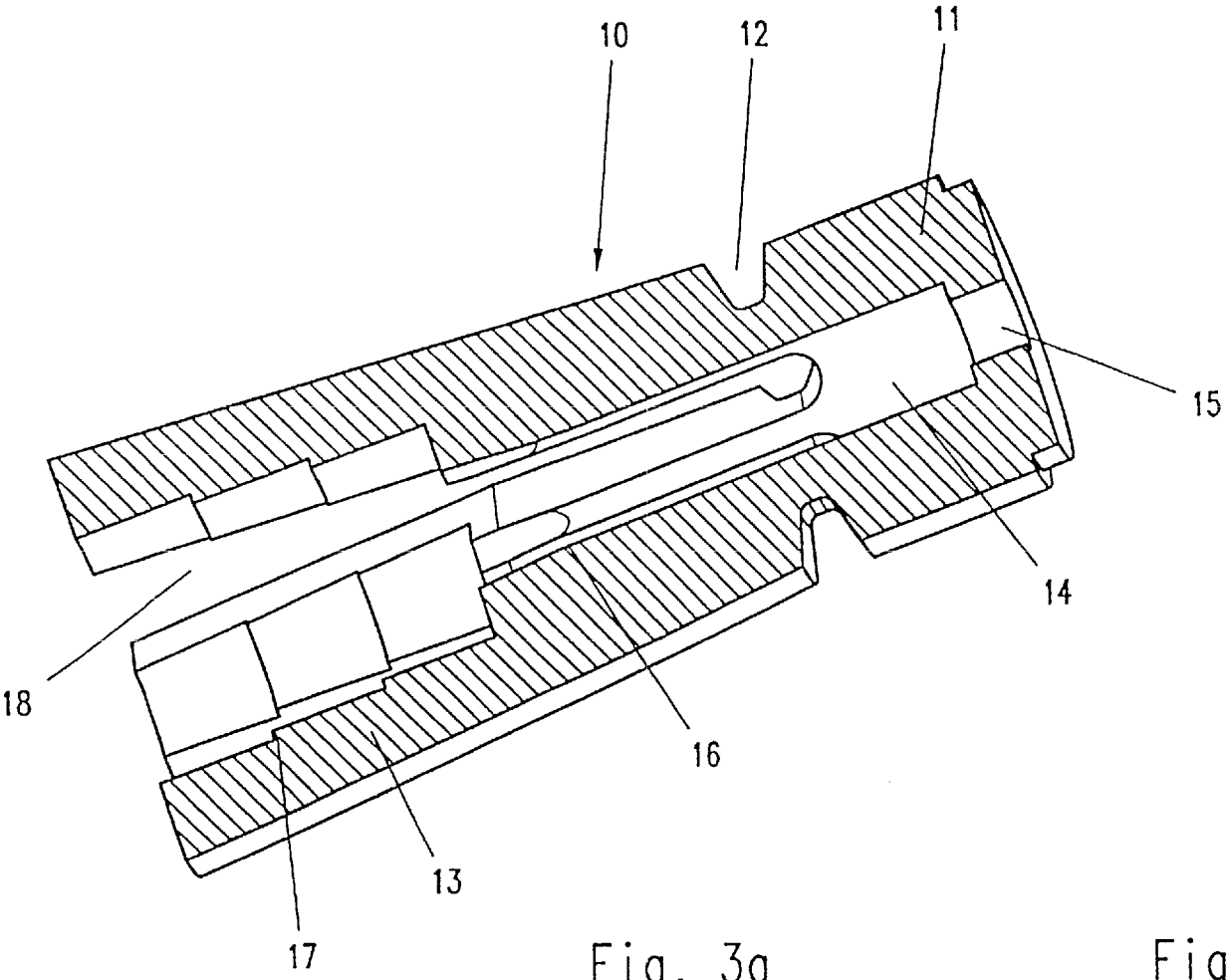

FIG. 3*a* shows an insulating body, and

FIG. 3*b* shows a lamellar spring with lamellae which are disposed in an inclined manner.

Figure 1:
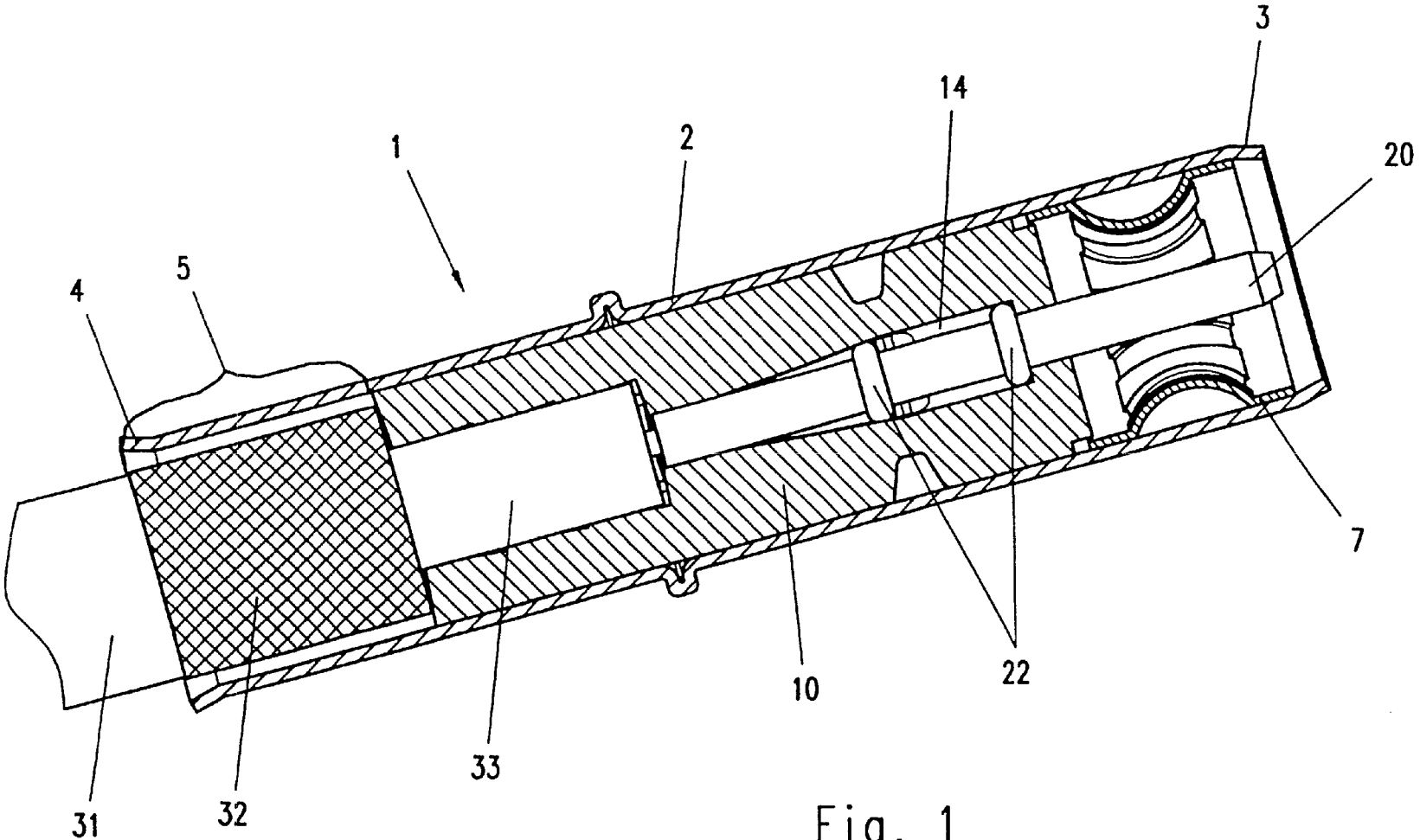
FIG. 1 shows a fitted plug connector.

A fitted plug connector 1 is represented in FIG. 1 in a sectional view. In a sleeve-shaped plug-in part 2, there is first of all provided, in the region of the plug-in side 3, an annularly disposed lamellar spring 7 which, although it is preferably provided with lamellae 8 which extend at an inclination to the direction of plugging-in, nevertheless has, in this example, lamellae which are orientated in the said direction of plugging-in.

Also pushed into the plug-in part is an insulating body 10 into which there is introduced a contact element 20 which points towards the plug-in side and is provided with a receiving bore 23 which points in the opposite direction to the said plug-in side and into which an electrical middle conductor 34 of a coaxial cable 30 with a sheathing 31 is pushed from the conductor-connecting side 4 of the plug connector.

The conductor-connecting side 4 of the sleeve-shaped plug-in part is provided in the form of a crimping-type connection 5, under which circumstances the said crimping operation, as well as mechanically retaining the coaxial cable, acts on the screening braid 32 located beneath it, and the screening action of the latter is transmitted to the electrically conductive plug-in part and is, in turn, transmitted, by means of the lamellar spring 7 provided on the plug-in side 3, to a counterplug or, in the event of direct plugging-in, to a suitably prepared printed circuit board. It can also be inferred from FIG. 1 that the front plug-in region 3 of the plug-in part 2 is bent inwards in an inclined manner, so that the lamellar spring 7, which is disposed in an annular manner inside the plug-in part and is also described as a "basket spring", can only be displaced as far as this narrowed portion and the inclination at the same time makes it easier to plug the plug-in part into a counterplug which is not shown here.

Figure 2:
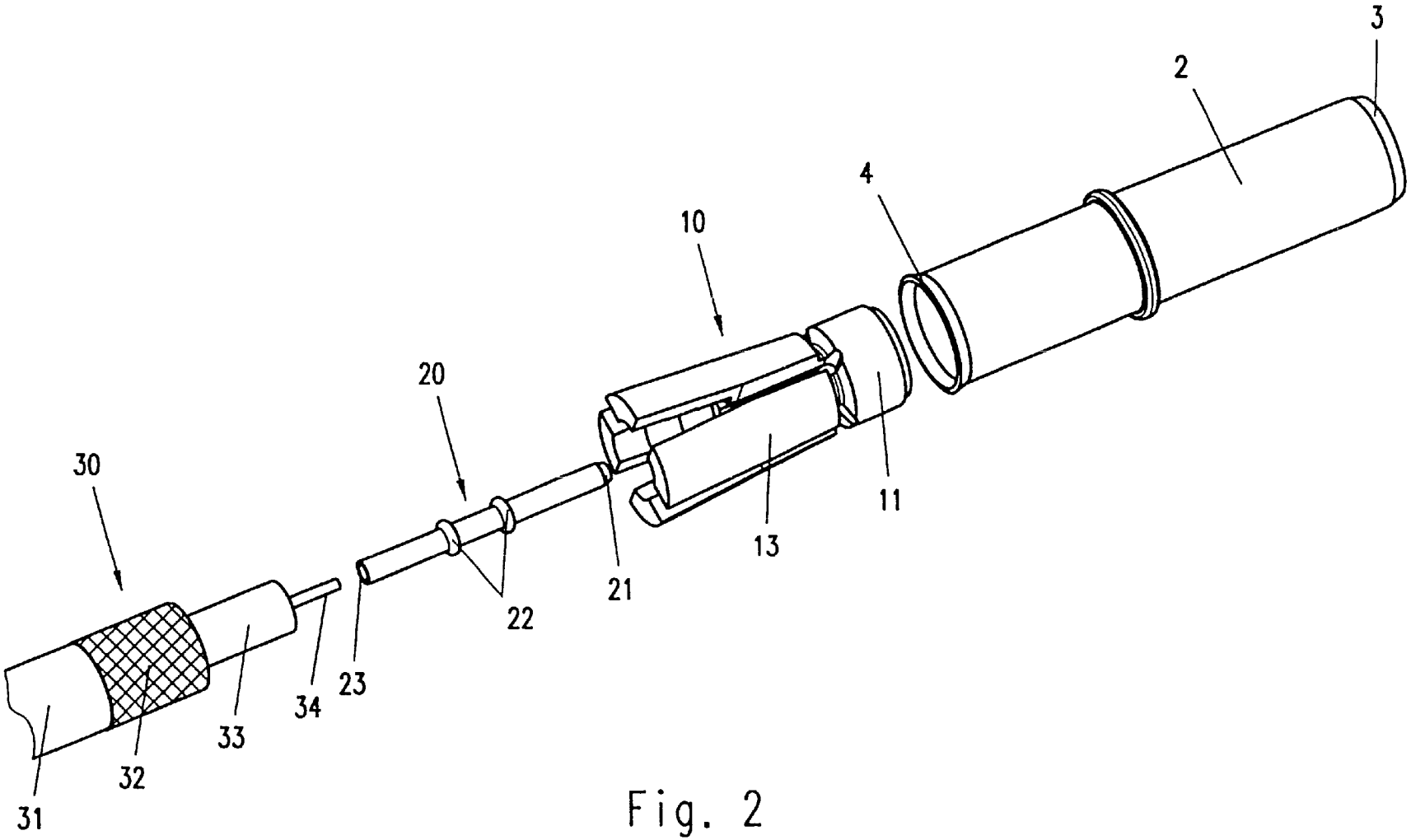
FIG. 2 shows the plug connector in an exploded drawing.

FIG. 2 shows, in an exploded drawing, the individual structural parts provided for the plug connector, in which connection the representation chosen at the same time corresponds to a fitting sequence.

When the plug connector is being fitted, the lamellar spring 7 is already contained in the sleeve-shaped plug-in part 2.

The coaxial cable 30 is first of all prepared for fitting, which can take place mechanically or even manually, to the plug connector 1, in that the outer sheath 31 is first of all removed, over a certain length, as far as the screening braid 32 lying beneath it, and the said screening braid is bent back onto the outer sheath which now lies further back.

The insulation 33, also called the "dielectric", for the electrical middle conductor 34 is then removed and the contact element 20 with the receiving aperture 23 is pushed onto the electrical middle conductor.

The insulating body 10, which is produced from an electrically insulating material, is then first of all pushed, with the tongues 13 spread apart, onto the contact element 20, in the process of which the contact element is first of all centred in the middle bore 14 and pushed onwards as far as the stop, and the contact element 20 projects, via its point 21, through the through-bore 15 in the direction of plugging-in, while at the same time the tongues 13 completely cover the insulation 33 of the coaxial cable.

The sleeve-shaped plug-in part 2 is thereupon pushed over the combination of the insulating body 10 and coaxial cable 30, in the process of which the tongues 13, which are still spread apart, are gradually pressed together by the plug-in part 2 and, in the process, first of all clamp-in the contact element 20 and then the insulation 33 by means of the gradations 17, so that axially operating forces are conducted from the coaxial cable to the plug connector and not to the electrical middle conductor.

A clamping action is also obtained on the two elevated thickened portions 22 of the contact element and also, as a result of the conical widened portion 16 of the bore 14, which widened portion now rests directly on the surface of the said contact element, in the region of the receiving aperture 23 for the electrical middle conductor 34. Finally, the sleeve of the plug-in part 2 and the coaxial cable are crimped to one another in the region of the screening braid on the connecting side 4.

FIG. 3*a* shows the insulating body 10 in a cut-away representation.

The insulating body has a head part 11 in the form of a body of revolution of elongated shape, and tongues 13 which are spread apart slightly in the outward direction from an annular groove 12 towards the opposite end, and are separated by longitudinal slots 18. Provided in the interior is a bore 14 with a through-bore 15 and also a conically widening region 16.

The contact element 20 is introduced into the bore 14 when the plug is fitted, in the process of which the conically shaped point of the contact element is pushed through the through-bore 15 on the head side 11 in the direction of plugging-in.

The bore 14 is shaped in such a way, for the purpose of receiving the contact element 20, that the thickened portions 22 are first of all forced against the inner wall of the insulating body 10, and the conical widened portion 16 then presses on the wall of the contact element as a result of the pressing together of the tongues 13 during the pushing of the insulating body into the sleeve-shaped plugging-in part, so that a pressure is at the same time exerted on the electrical conductor 34 of the coaxial cable, which electrical conductor has been introduced into the receiving bore 23.

The gradations 17 provided on the inner walls of the tongues 13 are forced into the insulation 33 when the insulating body is pushed together into the sleeve-shaped plug-in part 2, thereby already transmitting part of the tensile forces which can occur between the coaxial cable and the plug connector.

The remaining tensile forces are absorbed by means of a crimping operation, at the crimping-type connection 5 on the connecting side 4, onto the screen 32 and the outer sheath 31 located beneath it.

FIG. 3*b* shows a preferred embodiment of a lamellar spring 7 with lamellae 8 extending in an inclined manner, which spring has the advantage, compared with the lamellae which otherwise extend longitudinally in relation to the direction of plugging-in, that in the event of direct plugging onto a printed circuit board which is specially contoured for that purpose, the edges on the printed circuit board cannot become jammed into the gaps between the lamellae.

What is claimed is:

1. A plug connector for a coaxial cable having a plug-in side and a conductor-connecting side, comprising:

a sleeve-shaped metal plug-in part into which an insulating body is pushed;

a contact element is introduced into said insulating body; wherein a) the insulating body is provided, in a partial region, with tongues which are formed by a longitudinal slots and which point outwards; and b) that a number of different diameter central bores coaxially arranged in a row at free ends of the tongues configured in a widening gradations from an interior of the insulating body; and c) that a middle conductor of the conductor of the coaxial cable is introduced into a receiving bore in the contact element; and d) that the insulating body being pushed into the sleeve-shaped metal plug-in part with the outwardly pointing tongues are pressed together and exerting a pressure on an insulation of the middle conductor.

2. Plug connector according to claim 1, wherein the central bore in the insulating body has a conical widened portion.

3. Plug connector according to claim 1, wherein the electrical contact element has a conically shaped point on the plug-in side.

4. Plug connector according to claim 1, wherein the electrical contact element has spaced-apart thickened portions in the middle region.

5. Plug connector according to claim 1, wherein the outwardly pointing tongues extend from a head part, which is segregated by an annular groove, to the end of the insulating body.

6. Plug connector according to claim 1, wherein an annular lamellar spring, whose lamellae are disposed in an inclined manner with respect to the direction of plugging-in, is provided in the interior of the sleeve-shaped plug-in part on the plug-in side.

7. Plug connector according to claim 1, wherein the conductor-connecting side of the sleeve-shaped plug-in part is constructed as a crimping-type connection.

* * * * *

UNITED STATES PATENT AND TRADEMARK OFFICE

CERTIFICATE OF CORRECTION

PATENT NO. : 6,517,379 B2 
DATED : February 11, 2003
INVENTOR(S) : Leve

It is certified that error appears in the above-identified patent and that said Letters Patent is hereby corrected as shown below:

Title page,
Item [73], please change the assignee to -- Harting Automotive GmbH & Co. KG (DE). --

Signed and Sealed this

Seventeenth Day of June, 2003

JAMES E. ROGAN
*Director of the United States Patent and Trademark Office*